United States Patent [19]

Bresnick

[11] Patent Number: 4,526,459

[45] Date of Patent: Jul. 2, 1985

[54] MULTI-ROLL FUSING SYSTEM

[75] Inventor: Herbert L. Bresnick, Honeoye Falls, N.Y.

[73] Assignee: Xerox Corporation, Stamford, Conn.

[21] Appl. No.: 107,967

[22] Filed: Dec. 26, 1979

[51] Int. Cl.[3] ..... G03G 15/20

[52] U.S. Cl. ..... 355/3 FU; 219/216; 432/60

[58] Field of Search ..... 355/3 FU, 3 R; 219/216, 219/388; 432/59, 60

[56] References Cited

U.S. PATENT DOCUMENTS 3,945,726 3/1976 Ito et al. ..... 219/216 X
4,163,892 8/1979 Komatsu et al. ..... 432/60 X
4,172,975 10/1979 Noda ..... 432/60 X

*Primary Examiner*—R. L. Moses

[57] ABSTRACT

An improved fusing system for fusing toner images to copy sheets has a first roll and second and third rolls each in contact with the first roll to form a first nip between the first and second rolls and a second nip between the first and third rolls. Dual paper paths are provided with first feed means for feeding copy sheets to the first nip and second feed means for feeding copy sheets to the second nip. This permits copy sheets to pass through the fusing system in different directions which is important when there are paper path constraints as in duplex systems.

4 Claims, 2 Drawing Figures

1/1

MULTI-ROLL FUSING SYSTEM

The present invention relates to an improved fusing system for a copying machine.

In some copying machines, particularly those with duplex copy systems, it is sometimes desirable to have developed and transferred toner images pass through the fusing system in different directions due to paper path constraints. One way of accomplishing this would be to use a fusing system having two heater fuser rolls and two pressure rolls. This would, however, not only utilize valuable space, but would also add to the cost of the copying machine. Thus what is needed is an improved fusing system which is relatively economical and requires a minimum of space.

SUMMARY OF THE INVENTION

The present invention is directed to an improved fusing system for fusing toner images to copy sheets, the system having a first roll, and second and third rolls each in contact with the first roll to form a first nip between the first and second rolls and a second nip between the first and third rolls. Dual paper paths are provided with first feed means for feeding copy sheets to the first nip and second feed means for feeding copy sheets to the second nip.

DETAILED DESCRIPTION OF THE INVENTION

Figure 1:
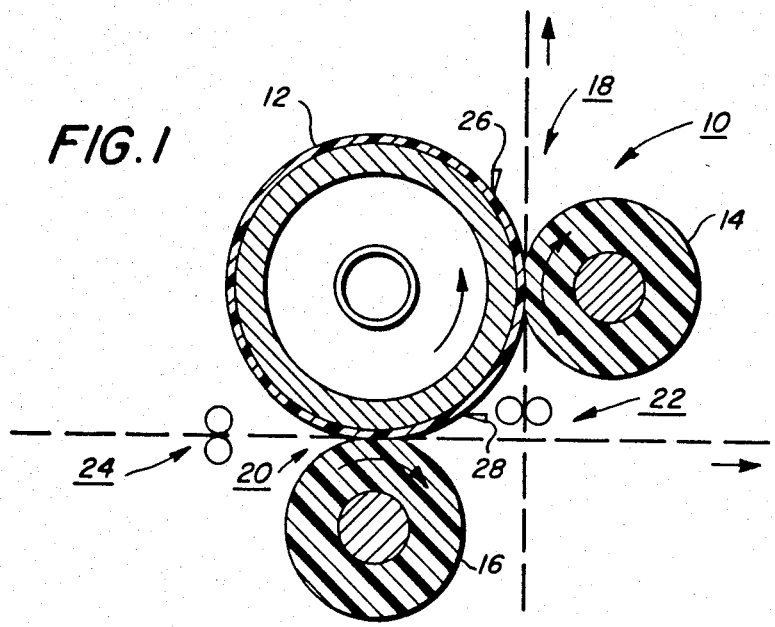
FIG. 1 is an enlarged view of the preferred embodiment of the invention.

Referring to FIG. 1, the invention will now be described in detail.

The multi-roll fusing system 10 includes a fuser roll 12 heated by any suitable heating element on the interior thereof. Pressure rolls 14 and 16 are in pressure contact with the heated fuser roller to form a first nip 18 and a second nip 20. To feed copy sheets to the first and second nips respectively, two pairs of feed rollers 22 and 24 are provided. As copy sheets pass through the nips 18 and 20, they are stripped from the fuser roll 12 by stripper fingers 26 and 28.

Figure 2:
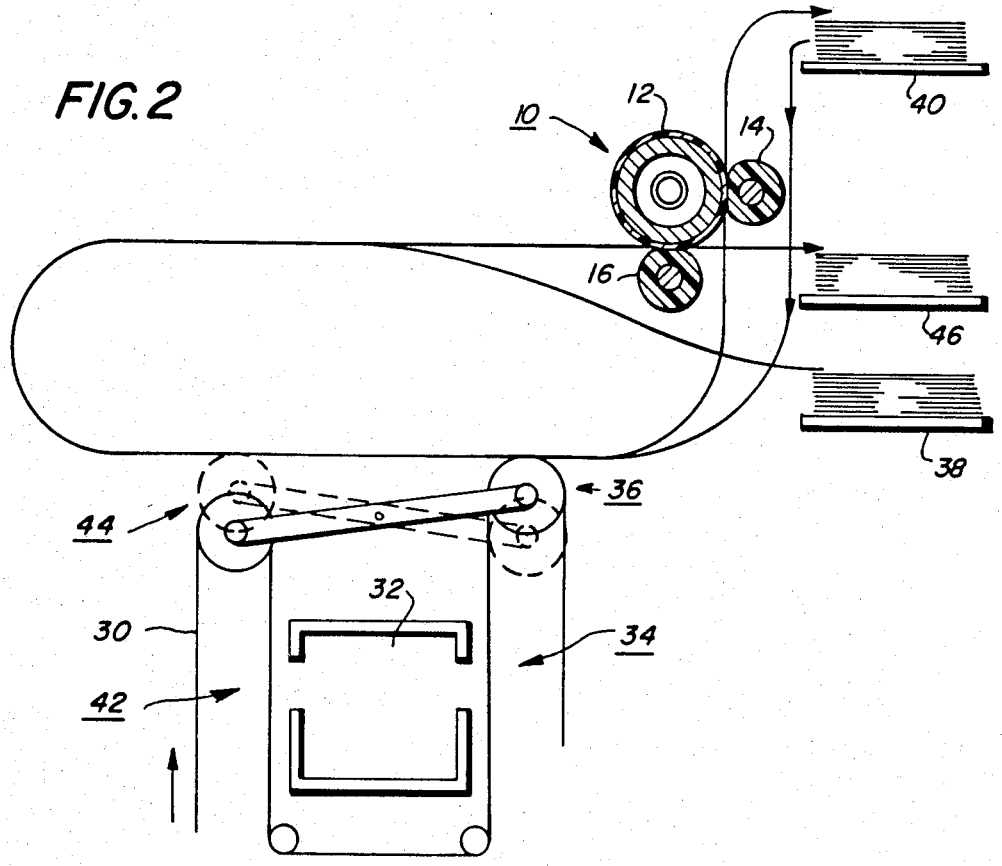
FIG. 2 shows one environment in which the present invention might be employed.

The system shown in FIG. 2 is one using a flexible image member and toner for developing latent images on the image member. It is to be understood, however, that the present invention is not limited to such an environment, but can be used in any environment in which toner images are to be fused to copy sheets. Image member 30 carrying simplex and duplex latent images moves from an imaging station past a developer 32 from left to right where latent images in development zone 34 of the developer are developed, after which the developed images are moved to transfer station 36. Copy sheets move from a supply tray 38 around the path shown to the transfer station 36 where the developed simplex images are transferred from the image member 30 to the copy sheets. The copy sheets are then fed between the fuser roll 12 and pressure roll 14 where the toner images are fused to the first sides of the sheets, inverted by any suitable means, and deposited into simplex tray 40. This procedure continues until all side-one copies from the job have been developed and transferred.

On the signal that all side-one copies of the job have been completed, the transfer station 44 is moved into position. The direction of movement of the image member 30 is now reversed and the duplex images are developed at development zone 42, after which the developed images are moved to transfer station 44. Inverted copy sheets now move from the simplex tray 40 to the transfer station 44 where the developed duplex images are transferred from the image member 30 to the second sides of the copy sheets. The copy sheets are then fed between the fuser roll 12 and the pressure roll 16, where the tone images are fused to the second sides of the sheets and are then deposited into duplex tray 46.

The advantages of the present invention are, as stated above, that it requires less space and is less costly than a fusing system requiring two separate fuser rolls. The invention could also be used in a completely simplex operation where simplex images are developed and transferred in both directions using two stacks of paper in trays 38 and 40.

While the invention has been described with reference to the structure disclosed, it is not confined to the details set forth, but is intended to cover such modifications or changes as may come within the scope of the following claims.

I claim:

1. Fuser apparatus for use in a copying machine wherein toner images are formed on both sides of copy sheets, said fuser apparatus comprising:

a first roll mounted for rotation;

a second roll cooperating with said first roll to form a nip for totally fusing toner images on a first side of said copy sheet;

a third roll mounted for cooperation with said first roll to form a second nip for totally fusing toner images on asecond side of said copy sheets; and said first and second nips being arranged such that they receive said copy sheets from different directions.

2. Apparatus according to claim 1 including first feed means disposed in a first path of travel of said copy sheets, said feed means being intermediate said first nip and an image transfer means for feeding said copy sheets with toner images on said first side to said first nip; and second means disposed in a second path of travel intermediate said second nip and said image transfer means for feeding said copy sheets with toner images on said second side to said second nip.

3. Apparatus according to claim 1 wherein said first roll is heated.

4. Apparatus according to claim 2 wherein said first roll is heated.

* * * * *